United States Patent [19]

Holmes

[11] 4,110,953

[45] Sep. 5, 1978

[54] RECLOSABLE BAG CLOSURE SYSTEM

[75] Inventor: Gordon W. Holmes, Mississauga, Canada

[73] Assignee: Professional Packaging Limited, Mississauga, Canada

[21] Appl. No.: 754,115

[22] Filed: Dec. 27, 1976

Related U.S. Application Data

[62] Division of Ser. No. 664,906, Mar. 8, 1976.

[30] Foreign Application Priority Data

Mar. 11, 1975 [GB] United Kingdom ..... 10177/75

[51] Int. Cl.[2] ..... B65B 7/08; B65B 7/04

[52] U.S. Cl. ..... 53/419; 53/487; 53/481; 53/482; 229/65

[58] Field of Search ..... 53/14, 46, 44, 45, 370, 53/15, 371, 41, 138 R, 138 A, 37; 229/62, 65, 66

[56] References Cited

U.S. PATENT DOCUMENTS

| | | | |
|---|---|---|---|
| 633,007 | 9/1899 | Humphrey | 53/14 X |
| 1,026,234 | 5/1912 | Abrahams | 53/138 R X |
| 1,766,405 | 6/1930 | Shaw | 53/46 X |
| 2,093,978 | 9/1937 | Farmer | 229/65 X |
| 2,134,567 | 10/1938 | Long et al. | 53/371 |
| 2,356,110 | 8/1944 | Waters | 229/65 X |
| 3,458,110 | 7/1969 | Goldman | 229/65 X |

*Primary Examiner*—Horace M. Culver
*Attorney, Agent, or Firm*—Sim & McBurney

[57] ABSTRACT

A novel bag closure system is provided which has considerable advantages over conventional tin tie closure systems. A specially-designed closure strip having bag material-receiving recesses is affixed to the bag and the bag is closed using the closure strip. Equipment is described for effecting the closure automatically.

4 Claims, 12 Drawing Figures

58
60
14
56
58
18
18
12
16

RECLOSABLE BAG CLOSURE SYSTEM

This is a division of application Ser. No. 664,906 filed Mar. 8, 1976.

FIELD OF INVENTION

This invention is directed to a novel bag closure and to systems for application thereof.

BACKGROUND TO THE INVENTION

For many years certain food products, such as baked goods, cookies, coffee etc., have been packaged in reclosable containers so that after opening of the container to remove some of the product, the container may be reclosed to maintain the freshness of the remainder of the product.

Such reclosable containers are commonly the so-called "tin-tie" bags. A thin metal strip covered with paper is bonded by the bag supplier to the top of the bag with the two ends extending about an inch beyond the lateral side edges of the bag. When the product is loaded into the bag the top is folded over two or three times and secured from reopening by folding under the extending ends of the tin-tie strips. Not all tin-tie strips are paper covered wire but the principle of operation of all such strips is the same.

When the consumer opens the bag, the strip ends first are unfastened by bending them out and then the top of the bag is unrolled. When sufficient product has been removed from the bag, the bag can be reclosed by reversing the opening procedure.

The tin-tie type bag closure system, while widely used, has several disadvantages for the bag and product manufacturers, the retailer and the consumer. Thus, the tin-tie closure is attached to the bag by the bag manufacturer, adding considerably to the cost of the bag. The increased thickness at one end of the bag and the projection of the wire tabs beyond each side of the bag increases the cost of packing and shipping.

The nature of the closure does not lend itself to automatic bag closing operations and it is necessary in most cases for the product manufacturer to close the bag completely on a manual basis. One operator is able to close about 5 or 6 bags a minute, leading to a very labor intensive operation where a high output is required, and consequently higher costs to the consumer.

Since the closure operation is purely manual and hence a human element is present in the efficiency of closure and owing to the resilient nature of the tin-tie closure, there is always a small percentage of bags which are not securely closed and which open during handling and shipping.

Such partially or completely open bags present an untidy appearance, distraction of product appeal and adversely affect display appearance and, in some cases product may be spilled out, leading to further problems. The partial or complete opening of the bag often leads to product deterioration. While such open bags normally should be returned to the manufacturer for credit, itself an inconvenience, often the retain outlet will reclose the open bag, an added inconvenience, possibly leading to the sale of stale products to the consumer, with consequential consumer dissatisfaction.

When the tin-tie closures are opened or closed, the wire strip may snap off with the hazard of injury to the consumer, thereby exposing the product manufacturer to the potential of liability claims, damage to brand image and loss of sales.

There are a variety of possible modes of utilization of the tin-tie system to effect bag closure and some consumers have difficulty in determining whether to fold the bag down and bend the wire tabs up or down, which may lead to inefficient reclosure, with consequent impairment of product on continued storage.

The tin-tie closure does not result in a factory-sealed package, but rather a readily-opened and-reclosed package. This renders the package susceptible to pilferage of product therefrom, especially at the retail level.

SUMMARY OF INVENTION

The present invention provides a novel bag closure which does not suffer from the defects of the prior art tin-tie closure and which is susceptible of adaption for automatic closure operation. In one embodiment of the invention, there is provided an automatic bag closure system.

DESCRIPTION OF PREFERRED EMBODIMENTS

Figures 1, 2A, 2B, 2C, 2D:
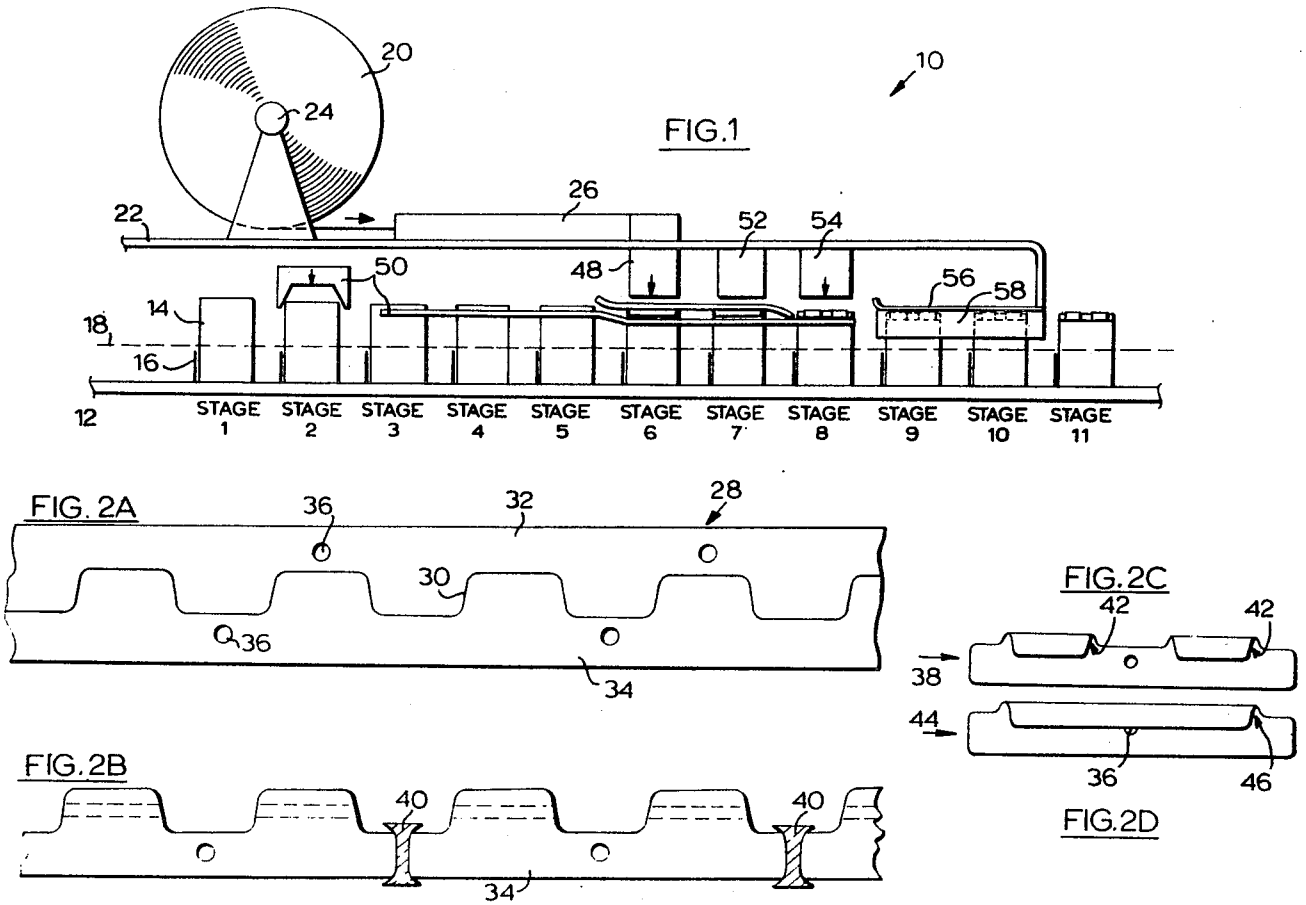
FIG. 1 is a schematic representation of an automatic bag closure system in accordance with one embodiment of the invention.
FIGS. 2A and 2B illustrate the formation of plastic closure strips used in the embodiment of FIG. 1.
FIGS. 2C and 2D illustrate alternative forms of plastic closure strip, the strip of FIG. 2C being formed by the procedure of FIGS. 2A and 2B.

Referring to the drawings, a reclosable bag closure forming machine 10 includes a horizontal bag conveyor 12 on which a plurality of individual cookie bags 14 are uprightly positioned in longitudinally-spaced relationship for the conducting of a plurality of operations as described below.

A plurality of pusher plates 16 is provided for engaging the rear wall of the cookie bag 14 for assisting movement of the bags 14 along the conveyor 12 from left to right as seen in FIG. 1. Longitudinally-extending stationary side guide rails 18 are provided at each side of the conveyor 12 for preventing lateral displacement of the bags 14 from the conveyor 12 during transportation on the conveyor 12.

A roll of thin flat strip plastic 20 is mounted to a frame member 22 for rotation about a generally horizontal axis 24 and for feed to an individual closure strip forming operation 26. The roll of thin flat strip plastic 20 may be formed in the following manner.

Strip-forming material is extruded from a suitable extruder in the appropriate thickness, the web being slit into individual strips on a continuous basis.

As seen in FIG. 2A, a continuous plastic strip 28 thus formed then is die cut with a generally castellated cut line 30, separating the strip into two mirror-image portions 32 and 34. Orifices 36 also are punched through the strip 28, simultaneously with the die cutting or in a separate operation, in diagonally adjacent pairs as illustrated.

By die cutting the strip 28 into the mirror-image portions 32 and 34, there is minimal loss of plastic material in forming the strips. Other, more wasteful procedures, may be utilized, if desired, but for reasons of economy it is preferred to utilize the die cutting operation just described.

The strips 32 and 34 are separated one from another and reeled into separate rolls 20.

In the strip former 26, the peak of each castellation of the strip 32 or 34 is folded back on itself about an axis about midway up the peak to form recesses or channels 42. The folding operation may be carried out using a suitable mandrel about fold lines formed in any convenient manner in the peak, as seen in FIG. 2B.

The use of preformed fold lines may be less desired since the fold lines provide the line of weakness in the closure strip which may contribute to premature failure. Simple molding about a round mandrel is the preferred manner of folding to provide the recess 42 since this operation does not result in a line of weakening.

During the bending of the strips 32 and 34, only the area of strip to be bent is heated so as to avoid any tendency to distortion in the heating operation. The mandrel about which the strip is bent itself may be cooled so as to chill the plastic material and set the closure strip before distortion can occur.

Individual closure strips 38 are formed from the folded strips 32 or 34 by punch cutting the strips as shown in FIG. 2B at the approximate mid-point of the valley of each castellation which is not adjacent an orifice 36 using a punch 40 which has contoured sides to provide rounded corners at each longitudinal end of the strip 38.

Any waste material from the closure strip-forming operations may be reground and recirculated to the extruder.

The individual closure strips 38 then are collated for sequential feed to successive bags 14, as described in more detail below.

The closure strip 38 may be formed of any desired material having the proper balance of rigidity, flexibility and forming characteristics, for example, high density polyethylene or high impact polystryrene and have any desired thickness, typically about 0.015 to 0.018 inches thick. The strips 28 may vary in width, depending on the size of closure strip 38 desired, with a one-inch width being a typical value.

If desired, the plastic material may be pigmented in any convenient manner to provide colour coordination with the bag 14.

The closure strip 38 may be provided in a uniform size that will accommodate variations in bag size. Such size variations often are used due to variations in cookie shapes, sizes and quantities. The ability to use a single closure strip which is useful for a range of bag widths, varying by as much as an inch, simplifies inventory problems and decreases material costs.

While a strip 38 as shown in FIG. 2C is the preferred closure strip for use in the present invention, having longitudinally spaced and separated recesses 42 for reasons which will become more apparent hereinafter, it is possible to utilize an alternative form of closure strip 44 as shown in FIG. 2D in which a single continous recess or channel 46 is provided.

The individual closure strips 38 are applied to the bags 14 by a strip applicator 48 of any convenient construction.

The frame 22 on which the reel 20 and the strip former 26 are mounted may be a bridge-type frame which may be readily raised or lowered by crank adjustment so as to quickly accommodate changes in bag heights.

The apparatus of FIG. 1 also includes a bag-folding mechanism 50 which folds the open end of the bag 14 upstream of the strip applicator 48 as described in more detail below. A hot melt adhesive applicator 52 is located immediately. downstream of the strip applicator 48 for application of adhesive to the exposed surface of the strip 38 after application of the closure strip 38 to the folded top portion of the bag. Typically, a gun-type electronically controlled adhesive applicator may be used.

A folding mechanism 54 is located immediately downstream of the adhesive applicator 54 and immediately upstream of a compression device 56 which holds the parts to be adhesively joined together while the adhesive sets. Side supporting members 58 are provided to support the bags during compression by the compression device 56.

A coding or indexing device may be provided in the machine of FIG. 1, if desired, to provide suitable date coding or the like to each bag.

While the invention has been described with reference to the automatic apparatus of FIG. 1, it is possible to provide a bag closure using the closure strips in alternative, but less preferred, manners. For example, it is possible to extrude or injection mold the closure strips and ship them in bulk to a user company, who would then apply them automatically to swift-moving bags on a conveyor system. Cartridge loading for such application may be used, but this alternative is not very attractive owing to the expense involved in utilizing the shipped closure strips and applying them to the bags.

OPERATION

The operation of apparatus 10 will now be described with reference thereto and with particular reference to FIGS. 3A to 3E. The cookie bag 14 is subjected to a number of operations as it passes through the apparatus 10 on the conveyor 12 and eleven separate stages of operation have been identified. The apparatus 10 operates continuously and hence there are eleven bags in the various stages of operation in the apparatus 10 at one time.

The first stage of operation is the filling of the bag 14 with the required quantity of cookies, or the like, from any convenient bulk source (not shown), typically by integrating the apparatus 10 with an existing packing system.

Figures 3A, 3B, 3C, 3D, 3E, 3F, 4:
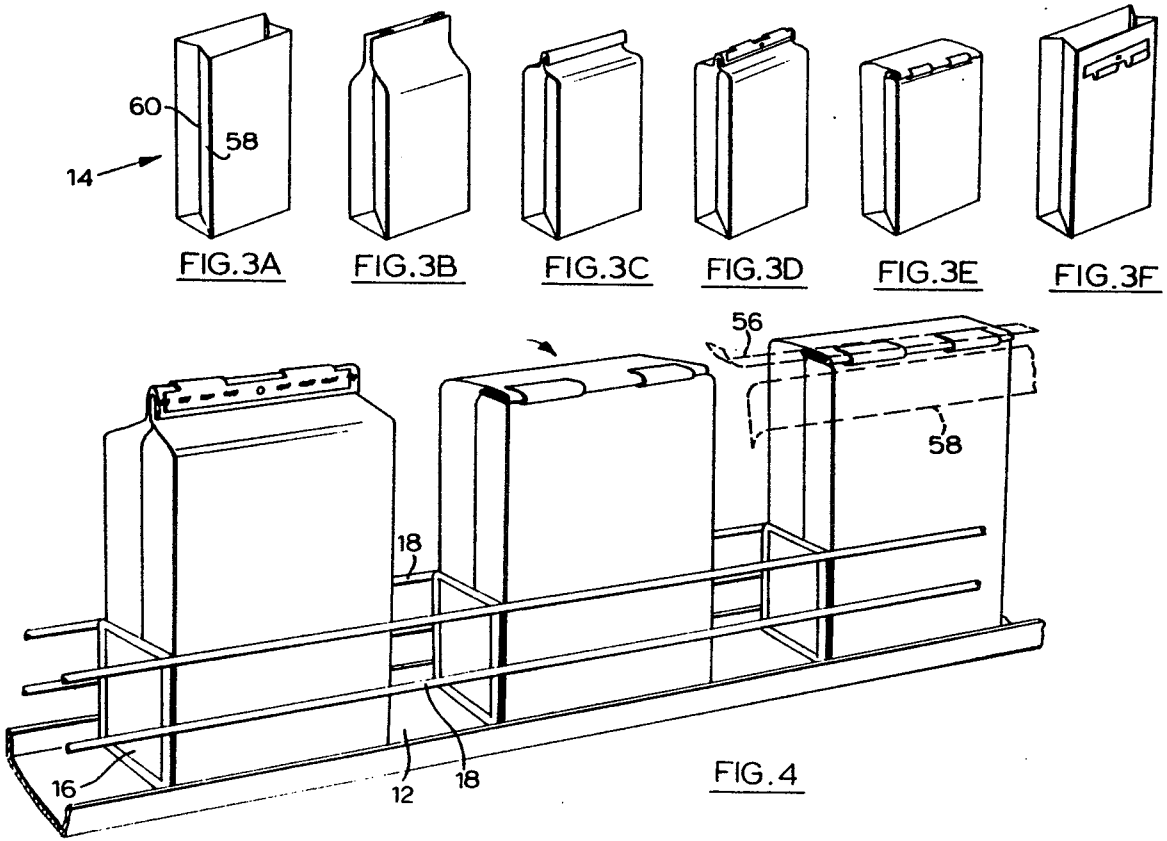
FIGS. 3A to 3E illustrate the steps involved in forming a bag closure in accordance with the present invention using the apparatus of FIG. 1.
FIG. 3F illustrates a reopened bag ready for reclosure.
FIG. 4 is a perspective view of a portion of the apparatus of FIG. 1.

During the filling operation (stage 1), the bag is fully open as seen in FIG. 3A so that the cookies may be readily fed thereto. The bag 14 has side walls 58 in which longitudinally-extending fold lines 60 are positioned.

The open mouth of the bag 14 then is closed by first bending the side walls inwardly about the fold line 60 (stage 2), closing the side walls 58 together adjacent the top of the bag (stage 3) and then pinching the top edges together (stage 4) to provide a bag 14 as shown in FIG. 3B.

Where the bag 14 is used with an inner plastic bag liner, a narrow heat seal strip may be provided by applying heat to the folded top of the bag when it is supported by the folding guide 50 on the closure machine 10. This narrow heat seal strip will further preserve product freshness and at the same time, makes it possible for the consumer to snap open the bag without ripping or destroying the bag.

In stage 5, the pinched top of the bag 14 is folded over a single time to provide a bag 14 which is ready to receive a closure strip 38 (FIG. 3C). The recesses 42 in the strip 38 are dimensioned to be about the thickness of the top of the bag when it has been folded over in this stage.

The strip 38 then is applied to the folded over top of the bag with the folded over top being received in the recesses 42 to the depth thereof in interference fit therewith (stage 6), as seen in FIG. 4.

Thereafter, adhesive is applied to the continous outer surface of the strip 38, either as a continuous or semi-continuous bead or as a series of dots from the applicator 52. The adhesive may also be applied to the bag surface beyond the lateral extremities of the strip 38 (stage 7).

The strip then is adhesively attached to the bag 14 by folding over the upwardly-projecting top portion of the bag 14 into engagement with the outer surface of the bag 14 to form a generally cubic bag 14 (stage 8) as shown in FIG. 3E.

In the next two stages (stages 9 and 10), the top of the folded bag 14 is compressed by the compressor bar 56 while the adjacent front and back faces of the bag 14 are supported by the supporting plates 57 to allow for setting of the adhesive, before recovery of the completed package (stage 11) illustrated in FIG. 3E.

The provision of the orifice 36 in the closure strip 38 results in adhesive projecting through from the adhesive-applied side of the strip 38 to the other and engaging the bag surface on that other side, thereby adhesively joining the bag surfaces. Extension of the application of adhesive beyond the lateral extremities of the strip 38 also results in adhesive joining of adjacent bag faces.

The adhesive connection of the adjacent bag faces in this way ensures that the bag is sealed when leaving the user company, so that the consumer has assurance of a fresh, untampered product packaged in this way.

The orifices 36 also may function as a registry and control opening for receipt of locater pins on the apparatus 10. In this way, the operators of the various portions of the apparatus may be coordinated, and accurate strip cut-off may be assured.

The apparatus 10 is capable of operating fully automatically to produce sealed packages in rapid and efficient manner. The apparatus 10 thus processes flexible material, which may be supplied in roll form, with processing means located in the packaging plant to complete the forming on the same machine applies it and closes the bag, with consequential beneficial results.

Bags closed using the closure system of the invention may be readily opened by lifting the portion of the turned-over top of the bag 14 positioned between the recesses 42, thereby releasing the adhesive connection and removing the bag top from the recesses 42. The rounded corners of the edges of the recesses 42 ensure that there are no sharp corners on which the bag may tear or on which the consumers might receive injury.

The closed bag 14 also may be opened from either end, the ends of the recesses 44 being contoured to allow the bag to slide along rounded edges when the bag top is disengaged from the closure, thereby preventing tear damage to the bag and prolonging the usefulness of the bag in maintaining product freshness.

The closure strip 38 includes portions which extend beyond the lateral extremities of the recesses 42 to provide a large adhesive bonding area for the strip. Further, the extended portions provide a good support base for the leverage applied to the closure strip 38 upon opening of the bag 14 from one end.

Once the turned-over top has been released from the recesses 42, access to the contents of the bag is readily had. The closure strip 38 remains in contact with the bag surface as seen in FIG. 3F, and the bag may be reclosed simply by folding over the top and reinserting the turned-over top into the recesses 42, to provide the bag 14 again in the form shown in FIG. 3E.

When the alternative closure strip 44 is used, the bag must be opened from either end by lifting up on the folded corner of the bag. The continuous nature of the recess 46 provides increased strength to the closure strip, ensuring that the closed top of the bag remains in a stright line providing improved neatness of appearance. This form of strip is less convenient since the modes of opening operation are less and its formation requires 25% more material in addition to a higher material waste level.

The bag closure of the invention offers considerable advantages over the prior art tin-tie system. Thus, the formation of the closed bag in this invention may be performed fully automatically with minimal labour, in contrast to the labour-intensive and human-factor-error-prone prior art operation. Since the closure in this invention does not need to be separately attached by the bag manufacturer, material cost is decreased by cutting mark-ups, and increased labour, handling and additional shipping costs. Accidental opening of the bag resulting from inefficient use of the tin-tie is eliminated by this invention. The adhesive joining of small portions of the bag ensures freshness of the product and guards against pilferage of products from within the bag.

The bag closure used in this invention is integrally formed, in contrast to the tin-tie which is a combination of different materials. The hazards caused by breaking off of tin-tie ends is eliminated by this invention. The closure strip 38 is provided throughout with rounded corners which do not expose the consumer to a safety hazard.

The raw material costs of the closures used in this invention are less than those of tin-ties, typically less than half the cost, leading to less expensive bags.

SUMMARY

The present invention, therefore, provides a novel reclosable bag closure system which has considerable technical and economic advantages over the prior art. Modifications are possible within the scope of the invention.

What I claim is:

1. A method for the formation of a closed, operable and reclosable bag structure, which comprises:

providing a bag having a generally rectangular base, generally rectangular front and rear walls upstanding from the integral with said base, generally rectangular side walls upstanding from said base and integral with said front and rear walls and said base, each of said side walls having a longitudinal fold line formed therein, and an open top, placing articles to be packaged by said bag therein, folding said side walls inwardly about said fold lines adjacent said open top, bringing the front and rear walls into abutting relationship adjacent the top edges thereof to close the open top of said bag while simultaneously abutting the folded side walls adjacent the top, folding a portion of said abutted faces downwardly and into abutting relationship with said front face, said portion corresponding in depth to approximately half the lateral dimensions of the base, forming elongate thin strips of polymeric material, die cutting a castellated shape longitudinally of said strip to separate the strip into two mirror image shaped strips, forming an orifice through said strips adjacent each alternate valley of the strip, separating the strips from each other, folding the peak of each castellation of each separate strip towards the remainder of the separate strip to form for each peak a recess between the folded-over portion and the remainder of the strip, separating individual elongate closure strips by cutting the strips transverse thereof in the alternate valley which does not have the orifice formed therethrough, positioning the recess of an individual closure strip in interference fit relationship with said folded portion of said bag with said remainder of the strip abutting said folded over portion on the front face thereof, applying adhesive to the exposed face of said remainder of said strip, folding said folded over portion to bring said remainder of said strip into engagement with an adjacent portion of said front face to provide a top closure wall parallel to said base constituted by the upper portion of said rear wall, curing said adhesive to achieve adhesive connection between said remainder of said closure and said engaged portion of said front face, and recovering the bag structure so formed.

2. The method of claim 1 wherein said castellated die cut has rounded ends and said separation of individual strips is carried out to provide rounded corners at each of the cuts.

3. The method of claim 1 including conveying said bag in an upright orientation generally horizontally during said operations.

4. The method of claim 1 wherein a plurality of said bags is serially subjected to said operations of article placement, folding, positioning said closure strip, adhesive application, folding, adhesive curing and bag structure recovery.

* * * * *